US005094929A

United States Patent [19]

Yagi et al.

[11] Patent Number: 5,094,929

[45] Date of Patent: Mar. 10, 1992

[54] ELECTROPHOTOGRAPHIC PHOTORECEPTOR WITH AMORPHOUS CARBON CONTAINING GERMANIUM

[75] Inventors: Shigeru Yagi; Masato Ono; Noriyoshi Takahashi; Masayuki Nishikawa; Yuzuru Fukuda; Ken-ichi Karakida, all of Kanagawa, Japan

[73] Assignee: Fuji Xerox Co., Ltd., Tokyo, Japan

[21] Appl. No.: 459,297

[22] Filed: Dec. 29, 1989

[30] Foreign Application Priority Data

Jan. 4, 1989 [JP] Japan ..... 64-000028
Jan. 4, 1989 [JP] Japan ..... 64-000029

[51] Int. Cl.[5] ..... G03G 5/14; G03G 5/082

[52] U.S. Cl. ..... 430/60; 430/58; 430/84; 430/85

[58] Field of Search ..... 430/58, 60, 85

[56] References Cited

U.S. PATENT DOCUMENTS 4,613,556 9/1986 Mort et al. ..... 430/66 X
4,663,258 5/1987 Pai et al. ..... 430/66 X
4,738,912 4/1988 Iino et al. ..... 430/58
4,755,444 7/1988 Karakida et al. ..... 430/66

*Primary Examiner*—Roland Martin
*Attorney, Agent, or Firm*—Finnegan, Henderson, Farabow, Garrett and Dunner

[57] ABSTRACT

An electrophotographic photoreceptor having a light-sensitive layer formed on an electrically conductive substrate is disclosed, which contains at least a layer chiefly made of a germanium-containing amorphous carbon as a light-sensitive layer or an anti-reflection layer.

16 Claims, 2 Drawing Sheets

ELECTROPHOTOGRAPHIC PHOTORECEPTOR WITH AMORPHOUS CARBON CONTAINING GERMANIUM

FIELD OF THE INVENTION

The present invention relates to an electrophotographic photoreceptor, particularly to an electrophotographic photoreceptor having a layer made of a germanium-containing amorphous carbon.

BACKGROUND OF THE INVENTION

Electrophotographic photoreceptors are generally formed by providing a light-sensitive layer on an electrically conductive substrate. Light sensitive layers are commonly made of materials having photoconductivity such as inorganic photoconductive materials (e.g. Se, CdS and ZnO) and organic photoconductive materials. Amorphous silicon and carbon have recently been proposed for use as photoconductive materials (see, for example, JP-A-54-86341 (the term "JP-A" as used hereinafter means an "unexamined published Japanese patent application"). Electrophotographic photoreceptors having light-sensitive materials made of amorphous silicon are principally formed by glow discharge. The resulting photoreceptors have the advantage of high sensitivity. Amorphous carbon has a very hard surface and withstands many cycles of use. In addition, amorphous carbon is not liable to change in quality. Hence, photoreceptors using light-sensitive layers made of amorphous carbon have the advantage of long service life.

However, electrophotographic photoreceptors using the materials listed above do not possess all of the characteristics that are required of photoreceptors to be used in electrophotography, and in commercial applications optimum conditions have to be searched for in accordance with the specific object of use. For instance, two major characteristics that are required to be possessed by electrophotographic photoreceptors are high sensitivity and high dark resistance. However, highly sensitive photoreceptors generally have small dark resistance and they often exhibit fatigue in their properties. Taking a photoreceptor having a Se-based photoconductive layer, for example, since selenium used alone has a narrow range of spectral sensitivity, sensitization is effected by addition of Te or As. Further, a single-layered structure containing Se is seldom used and a more common layer arrangement is a double-layered structure consisting of a Se layer and a SeTe layer, or a three-layered structure consisting of a Se layer, a SeTe layer and a Se layer. On the other hand, Se-based photoconductive layers containing Te or As suffer increased light fatigue, which causes a decrease in image density to either produce a ghost or deteriorate image quality.

Another fundamental characteristic that is required of electrophotographic photoreceptors is longevity of their life but photoreceptors using Se-based photoconductive layers do not have satisfactorily long life. For instance, Se in these photoreceptors is used in the amorphous state but it starts to crystallize at fairly low temperatures of 50° to 60° C. If crystallization occurs, the dark resistance of the photoreceptor decreases to cause deterioration of copied image.

The recently proposed photoreceptors using amorphous silicon as a photoconductive material have the advantages of high sensitivity, high resistance to cyclic use and long service life. However, because of high dielectric constant, a large charging current must be applied or the process speed must be increased in order to attain a desired surface potential. The application of a large charging current results in increased powder consumption and several problems must be solved before the system can be used at a higher process speed. The photoreceptors using amorphous silicon as a photoconductive material have the additional disadvantage that their resistance will vary greatly on account of external factors such as temperature and humidity to influence on charged potential, particularly in a hot and humid atmosphere. Further if a thin film made of an insulating material such as $SiO_2$ or SiN is formed on the surface of these photoreceptors as a barrier layer to prevent injection of charges, electric conductivity in a direction parallel to the interface will increase to cause occasional production of a blurred image. Further, the photoreceptors using amorphous silicon as a photoconductive material is so structure-sensitive that in order to insure good reproducibility of film formation, the conditions of fabrication and the amount of impurities to be added must be strictly controlled.

Electrophotographic printers that perform scanning with a laser beam on lines have conventionally used gas lasers that operate at comparatively short wavelengths, such as a He-Cd laser, an Ar laser and a He-Ne laser, but the use of semiconductor lasers as the source of laser beams has increased these days. Semiconductor lasers usually emit in the wavelength range longer than 750 nm and various proposals have been made to design electrophotographic photoreceptors that have a high-sensitivity characteristic in such a long wavelength range. For instance, it has been proposed that sensitization for longer wavelengths be effected by incorporating Ge into photoreceptors including those which use amorphous silicon as a photoconductive material (see JP-A-54-98588 and JP-A-57-172344). However, if photoreceptors having a high-sensitivity characteristic in the long wavelength range is exposed to light from a light source emitting at long wavelengths, particularly to a scanning semiconductor laser beam on an electrophotographic printer, moires will be produced to preclude the formation of an image of good quality.

As described above, the conventional electrophotographic photoreceptors in common use have their own merits and demerits and in commercial applications, optimum conditions have had to be searched for in accordance with the specific object of use.

SUMMARY OF THE INVENTION

An object, therefore, of the present invention is to provide an electrophotographic photoreceptor that has satisfactory electrophotographic characteristics, that is stable in properties even with environmental changes, and that has a long service life.

Another object of the present invention is to provide an electrophotographic photoreceptor that is capable of forming a moire free image even if it is exposed under a light source emitting at long wavelengths.

As a result intensive studies conducted in order to solve the problems of the prior art, the present inventors have found that a layer made of a germanium-containing amorphous carbon could be used as a component of an electrophotographic photoreceptor. The present invention has been accomplished on the basis of this finding.

That is, the present invention is an electrophotographic photoreceptor having a light-sensitive layer formed on an electrically conductive substrate, characterized in that said photoreceptor contains at least a layer chiefly made of a germanium-containing amorphous carbon.

BRIEF DESCRIPTION OF THE DRAWINGS

In FIG. 1, a light-sensitive layer 2 is formed on an electrically conductive substrate 1; in FIG. 2, a charge transport layer 2*a* is formed on an electrically conductive substrate 1 and overlaid with a charge generation layer 2*b*; in FIG. 3, the charge transport layer 2*a* and charge generation layer 2*b* formed on the conductive substrate 1 are overlaid with a surface protective layer 3; in FIG. 4, an anti-reflection layer 4 is provided on an electrically conductive substrate 1 and is successively overlaid with a light-sensitive layer 2 and a surface protective layer 3; and in FIG. 5, an anti-reflection layer 4 is formed on the conductive substrate 1 and is successively overlaid with a charge transport layer 2*a*, a charge generation layer 2*b* and a surface protective layer 3.

DETAILED DESCRIPTION OF THE INVENTION

A variety of electrically conductive substrates can be used in the present invention and they include aluminum, nickel, chromium, alloys such as stainless steel, plastic sheets and glass having an electrically conductive film, and paper rendered to have electric conductivity.

The layer chiefly made of a germanium-containing amorphous carbon which is to be used in the present invention may be provided as a light-sensitive layer and/or an anti-reflection layer on the electrically conductive substrate. The total amount of germanium and carbon in the layer is preferably 50 atomic % or more.

Figure 1:
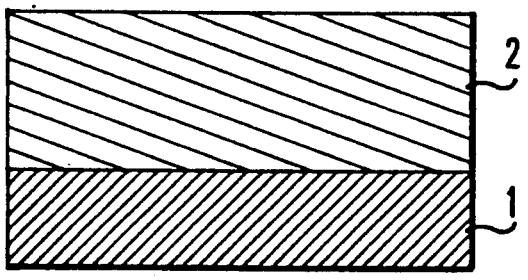
FIGS. 1 to 5 are cross sections that show schematically the electrophotographic photoreceptors of the present invention.

In the photoreceptor of the present invention, a light sensitive layer is provided on the conductive substrate. If the layer chiefly made of a germanium-containing amorphous carbon (hereinafter referred to as the germanium-containing amorphous carbon layer) is provided as a light-sensitive layer of a single-layered structure as shown in FIG. 1, the atomic ratio of germanium to carbon is preferably within the range of from 3:1 to 1:3 and more preferably from 2:1 to 1:2.

If the light-sensitive layer has a dual structure which is functionally separated into a charge generation layer and a charge transport layer, the germanium-containing amorphous carbon layer may be used either as a charge generation layer or as a charge transport layer. If the germanium-containing amorphous carbon layer has a smaller optical gap (generally by 0.5 eV or less and preferably by 0.05 to 0.3 eV) than that of the other layer, it is preferably used as a charge generation layer. If the germanium-containing amorphous carbon layer has a greater optical gap (generally by 0.05 eV or more and preferably by 0.1 to 0.3 eV) than that of the other layer, it is preferably used as a charge transport layer.

If the germanium-containing amorphous carbon layer is used as a charge generation layer, the atomic ratio of germanium to carbon is preferably within the range of from 1:1 to 1:0.01 and more preferably from 1:1 to 1:0.1. If the germanium-containing amorphous carbon layer is used as a charge transport layer, the germanium to carbon ratio is preferably within the range of from 0.01:1 to 1:1 and more preferably from 0.1:1 to 1:1.

The charge generation layer may be formed on the charge transport layer or vice versa. When the germanium-containing amorphous carbon layer is provided as a lower layer, the layer also serve as an anti-reflection layer as described later.

The germanium-containing amorphous carbon layer is prepared from a gaseous mixture of a germanium hydride compound, a hydrocarbon, and optionally hydrogen. The proportions of the individual components may be set as appropriate. Useful germanium hydride compounds include $GeH_4$, $Ge_2H_6$, $Ge_3H_8$, $Ge_4H_{10}$, $Ge_5H_{12}$, etc. Illustrative hydrocarbons include paraffinic hydrocarbons preferably having 1 to 4 carbon atoms, such as methane, ethane, propane and n-butane; olefinic hydrocarbons preferably having 2 or 3 carbon atoms, such as ethylene, propylene, butene-1, butene-2 and isobutylene; acetylene series hydrocarbons preferably having 2 or 3 carbon atoms, such as acetylene and methylacetylene; alicyclic hydrocarbons preferably having 3 to 7 carbon atoms, such as cyclopropane, cyclobutane, cyclopentane, cyclohexane and cyclobutene; and aromatic hydrocarbons such as benzene, toluene, xylene, naphthalene and anthracene. Halogen-substituted hydrocarbons may also be used, and examples are carbon tetrachloride, chloroform, carbon tetrafluoride, trifluoromethane, chlorotrifluoromethane, dichlorodifluoro methane, bromotrifluoromethane, fluoroethane and perfluoropropane. Diborane gas, phosphine gas and other dopant gases may be incorporated in the feed gaseous mixture for the purpose of further improving the electrophotographic characteristics of the photoreceptor.

The feed materials described above may be gaseous, solid or liquid at ordinary temperatures. Solid or liquid feed materials are vaporized before they are introduced into the reaction chamber.

The germanium-containing amorphous carbon layer can be formed by decomposing said feed gases in a plasma-assisted chemical vapor deposition (CVD) apparatus by glow discharge. Decomposition by glow discharge may be effected either by DC or AC discharge. To take AC discharge as an example, the following conditions may be employed to form a film: frequency, 0.1 to 30 MHz, preferably 5 to 20 MHz; pressure during discharging, 0.1 to 5 Torr (13.3 to 667 Pa); and substrate temperature, 100° to 400° C.

The thickness of the germanium-containing amorphous carbon layer may be set to a desired value. If it is used as a light-sensitive layer of a single-layered structure, its thickness is preferably within the range of 5 to 100 μm and more preferably 10 to 50 μm. If it is used as a charge generation layer in a dual structure, its thickness is preferably within the range of 0.1 to 20 μm and more preferably 0.2 to 5 μm, and if it is used as a charge transport layer, its thickness is preferably set to lie within the range of 1 to 100 μm and preferably 5 to 50 μm.

If the germanium-containing amorphous carbon layer is a charge generation layer, the charge transport layer is chiefly made of amorphous silicon. If the germanium-containing amorphous carbon layer is a charge transport layer, the charge generation is chiefly made of amorphous silicon. These silicon-containing layers can be formed by decomposing silicon compounds as reactive gases by glow discharge. More specifically, reactive gases chiefly made of silicon compounds are introduced into the reaction chamber in a plasma-assisted CVD apparatus and are decomposed by glow discharge to form the intended layer on the substrate or other layers (e.g., a charge transport layer, a charge generation layer, an anti-reflection layer, etc.) placed in the reaction chamber at a predetermined position. The content of silicon in the layer is preferably 50 atomic % or more.

Useful silicon compounds include $SiH_4$, $Si_2H_6$, $SiCl_4$, $SiHCl_3$, $SiH_2Cl_2$, $Si(CH_3)_4$, $Si_3H_8$, $Si_4H_{10}$, etc. If necessary, these silicon compounds may be used as admixtures with various carrier gases such as hydrogen, helium, argon and neon. Further, diborane gas, phosphine gas and other dopant gases may be mixed with the gases listed above for the purpose of further improving the electrophotographic characteristics of the light-sensitive layer using amorphous silicon as a photoconductive material.

The conditions of decomposition by glow discharge which is effected for the purpose of forming an amorphous silicon containing light sensitive layer using the feed gases described above are the same as those specified for the preparation of the germanium-containing amorphous carbon layer.

The germanium-containing amorphous carbon layer has high hardness, so if it is formed as a light-sensitive layer on the surface of an electrophotographic photoreceptor, it also serves as a surface protective layer. If a halogen such as fluorine is incorporated in this layer, preferably in an amount of 0.01 to 20 atomic %, its surface energy can be drastically reduced and the resulting photoreceptor will have a very good release property. The photoreceptor having this feature is capable of preventing the adsorption of various contaminants that will occur unavoidably during electrophotographic processing. Hence, not only influence of temperature and humidity but also deposition on the photoreceptor of ozone generated in the charging device, polymers in a developer and other components can be minimized to insure production of images having a highly stable image quality.

A surface protective layer typically made of silicon nitride, silicon carbide, silicon oxide or any other suitable material may be provided for the purpose of protecting the surface of the photoreceptor and improving its electrical characteristics. If the surface of the photoreceptor is not made of the germanium-containing amorphous carbon layer, a surface protective layer made of silicon nitride is preferably provided. The thickness of the surface protective layer is generally 0.1 to 10 μm and preferably 0.2 to 5 pm.

An intermediate layer may be provided between the conductive support and the light-sensitive layer for the purpose of blocking injection of charges or prevention of reflection.

According to another embodiment of the present invention, the germanium-containing amorphous carbon layer defined herein may be provided as an anti-reflection layer between the conductive substrate and the light sensitive layer. This embodiment is preferred in that it enables the formation of a moire-free image even if the photoreceptor is exposed under a light source emitting at long wavelengths. The anti-reflection layer preferably has a smaller optical gap by 0.5 eV or less than that of the light-sensitive layer in contact with it. It is generally preferred that the atomic ratio of the germanium to carbon in the anti-reflection layer is within the range of from 1:1 to 1:0.01 and preferably 1:0.5 to 1:0.01. Elements of group III (e.g., B, Al, Ga and In) or V (e.g., N, P, As and Sb) of the periodic table may be incorporated in the anti-reflection layer to provide it with a capability for preventing the injection of charges. The content of an element of Group III is generally within the range of 0.001 to 100 ppm and preferably 0.01 to 50 ppm. The content of an element of Group V is generally within the range of from 0.001 to 1,000 ppm and preferably 0.01 to 500 ppm.

The anti-reflection layer can be formed by decomposing feed gases by glow discharge in a plasma-assisted CVD apparatus. A gaseous mixture of a germanium hydride compound, a hydrocarbon (for specific examples of these compounds, see the description concerning the use of the germanium-containing amorphous carbon layer as a light-sensitive layer), and optionally hydrogen gas or diborane gas ($B_2H_6/H_2$) is used as a feed. The proportions of these components may be set as appropriate. The conditions of forming the anti-reflection layer are also the same as those employed for the formation of the germanium-containing amorphous carbon layer as a light-sensitive layer.

The thickness of the anti-reflection layer is preferably within the range of from 0.1 to 10 μm and more preferably 0.5 to 5 μm.

The light-sensitive layer to be formed on the anti-reflection layer may be of a single-layered structure or a dual structure which is functionally separated into a charge transport layer and a charge generation layer. If a dual structure is adopted, the charge generation layer may be formed of amorphous silicon or germanium-containing amorphous silicon.

When the light-sensitive layer is chiefly made of amorphous silicon can, the layer is formed by decomposition through glow discharge using reactive gases that are the same silicon compounds as described above. When the light-sensitive layer is chiefly made of amorphous carbon or a germanium-containing amorphous carbon, the layer may be formed by performing decomposition through glow discharge under the same conditions as described above using the same feed materials as those described in connection with the anti-reflection layer. For example, an amorphous carbon layer can be formed using a hydrocarbon and hydrogen gas as reactive starting materials, and a germanium-containing amorphous carbon layer can be formed using a germanium hydride compound, a hydrocarbon and, optionally, hydrogen gas as reactive starting materials. In the case of forming the germanium-containing amorphous carbon layer on the anti-reflection layer, these layers can be functionally differentiated, for example, by adjusting the content of boron in the layers such that the anti-reflection layer contains a larger amount of boron than the other, and the anti-reflection layer preferably has a smaller optical gap, preferably by 0.05 to 0.5 eV, than that of the other.

The following examples are provided for the purpose of further illustrating the present invention but are in no way to be taken as limiting.

EXAMPLE 1

A cylindrical aluminum substrate was placed in a capacitively coupled plasma-assisted CVD apparatus on a predetermined position. A mixture of germane ($GeH_4$) gas, methane ($CH_4$) gas and hydrogen ($H_2$) gas was introduced into the reaction chamber and decomposed by glow discharge to form a 15-μm thick photoconductive layer of germanium-containing amorphous carbon on the aluminum substrate, as shown in FIG. 1. The following conditions were used to form this photoconductive layer:

| | |
|---|---|
| Flow rate of 50% $H_2$ diluted germane gas | 20 $cm^3$/min |
| Flow rate of methane gas | 200 $cm^3$/min |
| Flow rate of hydrogen gas | 100 $cm^3$/min |
| Pressure in the reactor | 0.5 Torr |
| Discharging power | 200 W |
| Discharging frequency | 13.56 MHz |
| Substrate temperature | 250° C. |

The photoconductive layer thus formed had an optical gap of 1.6 eV. Germanium accounted for 54 atomic % of the photoconductive layer.

The electrophotographic photoreceptor thus fabricated was positively charged with a corotron in the dark with a voltage of 6.5 kV by usual manner. The charged potential was 400 volts and the dark decay rate was 15% per second. The photoreceptor was exposed imagewise under a tungsten lamp through a filter passing light laving a wavelength of 800 nm. The half decay exposure (an exposure amount necessary for decreasing the surface potential to half of the initial suface potential) was 10 erg/$cm^2$, and the residual potential was 100 volts. The latent electrostatic image was developed with a two-component developer by the magnetic brush method, and the toner image was transferred onto plain paper. The transferred image had good quality.

COMPARATIVE EXAMPLE 1

A cylindrical aluminum substrate was placed in a capacitively coupled plasma-assisted CVD apparatus on a predetermined position. A mixture of silane ($SiH_4$) gas, diborane ($B_2H_6$) gas and hydrogen ($H_2$) gas was introduced into the reaction chamber and decomposed by glow discharge to form a 2 μm thick amorphous silicon containing p-type photoconductive layer as an intermediate layer on the aluminum substrate. The following conditions were used to form this photoconductive layer:

| | |
|---|---|
| Flow rate of 100% silane gas | 100 $cm^3$/min |
| Flow rate of 100 ppm $H_2$ diluted diborane gas | 100 $cm^3$/min |
| Flow rate of hydrogen gas | 100 $cm^3$/min |
| Pressure in the reactor | 1.0 Torr |
| Discharging power | 200 W |
| Discharging frequency | 13.56 MHz |
| Substrate temperature | 250° C. |

Subsequently, a 15-μm thick amorphous silicon containing i-type photoconductive layer was formed under the same conditions as used above except that the 100 ppm $H_2$ diluted diborane gas was replaced by 2 ppm $H_2$ diluted diborane gas.

The electrophotographic photoreceptor thus fabricated was positively charged with a corotron in the dark with a voltage of 6.5 kV by usual manner. The charged potential was 350 volts and the dark decay rate was 25% per second. The photoreceptor was exposed imagewise under a tungsten lamp through a filter in the same manner as in Example 1. The half decay exposure was 20 erg/$cm^2$.

EXAMPLE 2

A 15-μm thick amorphous silicon containing i-type photoconductive layer was formed as a charge transport layer on a cylindrical aluminum substrate under the same conditions as used in Comparative Example 1. This charge transport layer had an optical gap of 1.7 eV.

Figure 2:
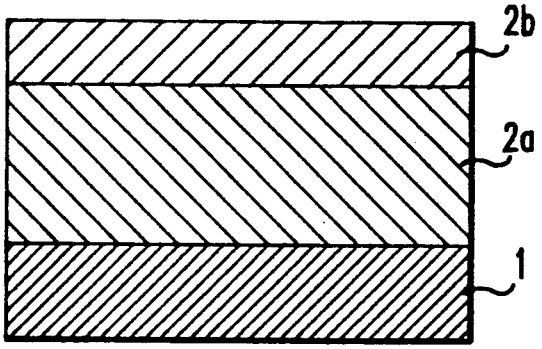

Subsequently, a mixture of reactive gases, i.e., germane gas, methane gas and hydrogen gas was introduced into the reaction chamber and decomposed by glow discharge to form a 0.5-μm thick charge generation layer of germanium-containing amorphous carbon on the charge transport layer, as shown in FIG. 2. The following conditions were used to form this charge generation layer:

| | |
|---|---|
| Flow rate of 50% $H_2$ diluted germane gas | 20 $cm^3$/min |
| Flow rate of methane gas | 200 $cm^3$/min |
| Flow rate of 100 ppm $H_2$ diluted diborane gas | 10 $cm^3$/min |
| Flow rate of hydrogen gas | 100 $cm^3$/min |
| Pressure in the reactor | 0.5 Torr |
| Discharging power | 200 W |
| Discharging frequency | 13.56 MHz |
| Substrate temperature | 250° C. |

The charge generation layer thus formed had an optical gap of 1.6 eV. Germanium accounted for 54 atomic % of the charge generation layer.

The electrophotographic photoreceptor thus fabricated was positively charged with a corotron in the dark with a voltage of 6.5 kV by usual manner. The charged potential was 400 volts. The photoreceptor was exposed imagewise under a tungsten lamp through a filter in the same manner as in Example 1. The half decay exposure was 10 erg/$cm^2$. The latent electrostatic image was developed with a two-component developer by the magnetic brush method, and the toner image was transferred onto plain paper. The transferred image had good quality.

EXAMPLE 3

A cylindrical aluminum substrate was placed in a capacitively coupled plasma-assisted CVD apparatus on a predetermined position. A mixture of germane gas and methane gas was introduced into the reaction chamber and decomposed by glow discharge to form a 15-μm thick charge transport layer of germanium-containing amorphous carbon on the aluminum substrate. The following conditions were used to form this charge transport layer:

| | |
|---|---|
| Flow rate of 50% $H_2$ diluted germane gas | 8 $cm^3$/min |
| Flow rate of methane gas | 200 $cm^3$/min |
| Flow rate of 100 ppm $H_2$ diluted diborane gas | 10 $cm^3$/min |
| Pressure in the reactor | 0.5 Torr |
| Discharging power | 200 W |
| Discharging frequency | 13.56 MHz |
| Substrate temperature | 150° C. |

The charge transport layer thus formed had an optical gap of 2.0 eV. Germanium accounted for 47 atomic % of the charge transport layer.

Subsequently a mixture of silane gas, diborane gas and hydrogen gas was introduced into the reaction chamber and decomposed by glow discharge to form a 1-μm thick charge generation layer of amorphous silicon on the charge transport layer. The following conditions were used to form this charge generation layer:

| | |
|---|---|
| Flow rate of 100% silane gas | 100 $cm^3$/min |
| Flow rate of 2 ppm $H_2$ diluted diborane gas | 100 $cm^3$/min |
| Flow rate of hydrogen gas | 100 $cm^3$/mn |
| Pressure in the reactor | 1.0 Torr |
| Discharging power | 200 W |
| Discharging frequency | 13.56 MHz |
| Substrate temperature | 250° C. |

The charge generation layer thus formed had an optical gap of 1.7 eV.

Figure 3:
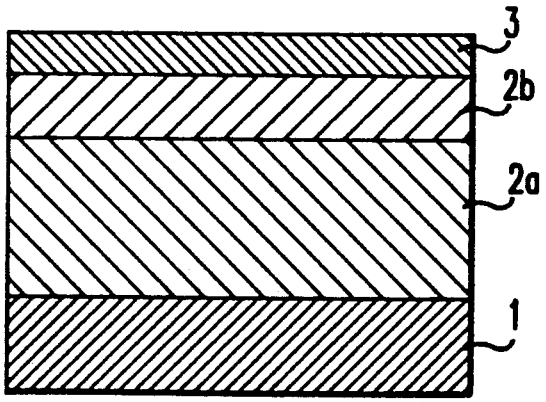

Subsequently, a mixture of reactive gases, i.e., silane gas, ammonia gas and hydrogen gas, was introduced into the reaction chamber and decomposed by glow discharge to form a 0.2 μm thick surface protective layer of amorphous silicon nitride on the charge generation layer, as shown in FIG. 3. The following conditions were used to form this protective layer:

| | |
|---|---|
| Flow rate of silane gas | 50 $cm^3$/min |
| Flow rate of ammonia gas | 50 $cm^3$/min |
| Flow rate of hydrogen gas | 100 $cm^3$/min |
| Pressure in the reactor | 0.5 Torr |
| Discharging power | 200 W |
| Discharging frequency | 13.56 MHz |
| Substrate temperature | 250° C. |

The electrophotographic photoreceptor thus fabricated was positively charged with a corotron in the dark with a voltage of 6.5 kV by usual manner. The charged potential was 400 volts and the dark decay rate was 10% per second. The photoreceptor was exposed imagewise under a tungsten lamp and the latent electrostatic image was developed with a two-component developer by the magnetic brush method. The resulting toner image was transferred onto plain paper. The transferred image had good quality.

EXAMPLE 4

A cylindrical aluminum substrate was placed in a capacitively coupled plasma-assisted CVD apparatus on a predetermined position. A mixture of germanium hydride ($GeH_4$) gas, methane gas and hydrogen gas was introduced into the reaction chamber and decomposed by glow discharge to form a 2-μm thick anti-reflection layer of germanium-containing amorphous carbon on the aluminum substrate. The following conditions were used to form this anti-reflection layer.

| | |
|---|---|
| Flow rate of 50% $H_2$ diluted germane gas | 40 $cm^3$/min |
| Flow rate of methane gas | 200 $cm^3$/min |
| Flow rate of 100 ppm $H_2$ diluted diborane gas | 40 $cm^3$/min |
| Flow rate of hydrogen gas | 80 $cm^3$/min |
| Pressure in the reactor | 0.5 Torr |
| Discharging power | 200 W |
| Discharging frequency | 13.56 MHz |
| Substrate temperature | 250° C. |

The anti-reflection layer thus formed had an optical gap of 1.5 eV. Germanium accounted for 57 atomic % of the anti-reflection layer.

Subsequently, a mixture of reactive gases, i.e., silane gas, diborane gas and hydrogen gas, was introduced into the reaction chamber and decomposed by glow discharge to form a 15-μm thick light-sensitive layer chiefly composed of amorphous silicon on the aluminum substrate. The following conditions were used to form this light-sensitive layer.

| | |
|---|---|
| Flow rate of 100% silane gas | 200 $cm^3$/min |
| Flow rate of 20 ppm $H_2$ diluted diborane gas | 20 $cm^3$/min |
| Flow rate of hydrogen gas | 180 $cm^3$/min |
| Pressure in the reactor | 1.0 Torr |
| Discharging power | 200 W |
| Discharging frequency | 13.56 MHz |
| Substrate temperature | 250° C. |

The light-sensitive layer thus formed had an optical gap of 1.7 eV.

Figure 4:
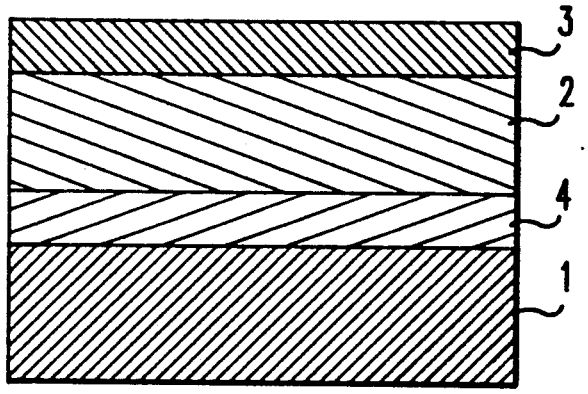
Figure 5:
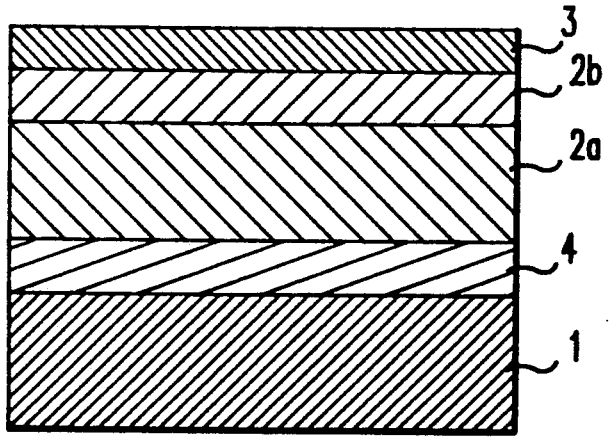

Subsequently, a mixture of reactive gases, i.e., silane gas, ammonia gases and hydrogen gas, was introduced into the reaction chamber and decomposed by glow discharge to form a 0.1-μm t hick surface protective layer of amorphous silicon nitride on the light-sensitive layer, as shown in FIG. 4. The following conditions were used to form this protective layer:

| | |
|---|---|
| Flow rate of silane gas | 50 $cm^3$/min |
| Flow rate of ammonia gas | 50 $cm^3$/min |
| Flow rate of hydrogen gas | 100 $cm^3$/min |
| Pressure in the reactor | 0.5 Torr |
| Discharging power | 200 W |
| Discharging frequency | 13.56 MHz |
| Substrate temperature | 250° C. |

The electrophotographic photoreceptor thus fabricated was positively charged with a corotron in the dark with a voltage of 7 kV by usual manner. The charged potential was 400 volts. The photoreceptor was exposed imagewise under a tungsten lamp through a filter passing light having a wavelength of 780 nm. The half decay exposure was 20 erg/$cm^2$. When this photoreceptor was processed with a printer using a semiconductor laser emitting at 780 nm as a scanning beam source, a moire-free image was produced.

COMPARATIVE EXAMPLE 2

An additional electrophotographic photoreceptor was fabricated by repeating the procedure of Example 4 except that an anti-reflection layer was not formed. This photoreceptor was charge, exposed and developed with a two-component developer by the magnetic brush method as in Example 4. When the toner image was transferred onto plain paper, a moire pattern was observed.

EXAMPLE 5

A 2-μm anti-reflection layer made of germanium-containing amorphous carbon was formed on a cylindrical aluminum substrate as in Example 4.

Subsequently, a mixture of reactive gases, i.e., ethylene gas and hydrogen gas, was introduced into the reaction chamber and decomposed by glow discharge to form a 10-μm thick charge transport layer of hydrogen-containing amorphous carbon on the anti-reflection layer. The following conditions were used to form this charge transport layer.

| | |
|---|---|
| Flow rate of ethylene gas | 100 $cm^3$/min |
| Flow rate of hydrogen gas | 50 $cm^3$/min |
| Flow rate of 100 ppm $H_2$ diluted diborane gas | 50 $cm^3$/min |

-continued

| | |
|---|---|
| Pressure in the reactor | 0.5 Torr |
| Discharging power | 500 W |
| Discharging frequency | 13.56 MHz |
| Substrate temperature | 250° C. |

Subsequently, a mixture of reactive gases, e.g., germane gas, methane gas and hydrogen gas, was introduced into the reaction chamber and decomposed by glow discharge to form a 0.5-μm thick charge generation layer of germanium-containing amorphous carbon on the charge transport layer. The following conditions were used to form this charge generation layer:

| | |
|---|---|
| Flow rate of 50% $H_2$ diluted germane gas | 40 $cm^3$/min |
| Flow rate of methane gas | 200 $cm^3$/min |
| Flow rate of hydrogen gas | 100 $cm^3$/min |
| Pressure in the reactor | 0.5 Torr |
| Discharging power | 200 W |
| Discharging frequency | 13.56 MHz |
| Substrate temperature | 250° C. |

The charge generation layer thus formed had an optical gap of 1.6 eV. Germanium accounted for 54 atomic % of the charge generation layer.

The electrophotographic photoreceptor thus fabricated was positively charged with a corotron in the dark with a voltage of 7 kV by usual manner. The charged potential was 400 volts. The photoreceptor was exposed imagewise under a tungsten lamp through a filter passing light having a wavelength of 780 nm. The half decay exposure was 10 erg/$cm^2$. When this photoreceptor was processed with a printer using a semiconductor laser emitting at 780 nm as a scanning beam source, a moire-free image was produced.

As will be understood from the foregoing examples, the electrophotographic photoreceptor of the present invention offers the following advantages:

(1) it resists light fatigue and can be used in continuous copying without causing deterioration of image quality;

(2) it remains stable and is durable in repeated use in electrophotographic processes and hence has a long service life;

(3) it has such a high photosensitivity that versions having spectral sensitivities in the longer wavelength range can be produced;

(4) it has low dielectric constant and can be charged with a smaller current;

(5) it has high dark resistance and exhibits little variation in charged potential even with changes in environmental factors such as temperature and humidity;

(6) it also exhibits little reduction in resolution due to the changes in environmental factors; and (7) if a germanium-containing amorphous carbon layer is provided as an anti-reflection layer, a moire-free image of good quality can be produced even when a light source emitting at long wavelengths is used.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor having on an electrically conductive substrate a light-sensitive layer composed of a charge generation layer and a charge transport layer, wherein said charge generation layer is chiefly made of a germanium-containing amorphous carbon and wherein an atomic ratio of germanium to carbon contained in said charge generation layer is from 1/1 to 1/0.01.

2. An electrophotographic photoreceptor as in claim 1, wherein said atomic ratio of germanium to carbon is 1/1 to 1/0.1.

3. An electrophotographic photoreceptor as in claim 1, wherein the thicknesses of said charge generation layer and said charge transport layer are from 0.1 to 20 μm and from 1 to 100 μm, respectively.

4. An electrophotographic photoreceptor having on an electrically conductive substrate a light-sensitive layer composed of a charge generation layer and a charge transport layer, wherein said charge generation layer is chiefly made of a germanium-containing amorphous carbon and wherein the total content of germanium and carbon in said charge generation layer is at least 50 atomic percent.

5. An electrophotographic photoreceptor as in claim 1, wherein said charge generation layer has an optical gap smaller by not more than 0.5 eV than the optical gap of said charge transport layer.

6. An electrophotographic photoreceptor as in claim 5, wherein said charge generation layer has an optical gap smaller by 0.05 to 0.3 eV than the optical gap of said charge transport layer.

7. An electrophotographic photoreceptor as in claim 1, wherein said charge transport layer is a photoconductive layer chiefly made of amorphous silicon.

8. An electrophotographic photoreceptor having a light-sensitive layer on an electrically conductive substrate, and an anti-reflection layer composed of a germanium-containing amorphous carbon between the substrate and the light-sensitive layer and wherein the atomic ratio of germanium to carbon in said anti-reflection layer is from 1/1 to 1/0.01.

9. An electrophotographic photoreceptor as in claim 8, wherein the total content of germanium and carbon in said anti-reflection layer is at least 50 atomic percent.

10. An electrophotographic photoreceptor as in claim 8, wherein said anti-reflection layer has an optical gap smaller by not more than 0.5 eV than the optical gap of said light-sensitive layer.

11. An electrophotographic photoreceptor as in claim 8, wherein said anti-reflection layer further contains an element of Group III or V of the periodic table.

12. An electrophotographic photoreceptor as in claim 11, wherein said anti-reflection layer contains 0.001 to 100 ppm of an element of Group III, or 0.001 to 1000 ppm of an element of Group V.

13. An electrophotographic photoreceptor as in claim 11, wherein said anti-reflection layer contains 0.01 to 50 ppm of an element of Group III, or 0.01 to 500 ppm of an element of Group V.

14. An electrophotographic photoreceptor as in claim 8, wherein said anti-reflection layer has a thickness of from 0.1 to 10 μm.

15. An electrophotographic photoreceptor as in claim 14, wherein said anti-reflection layer has a thickness of from 0.5 to 5 μm.

16. An electrophotographic photoreceptor as in claim 8, wherein said light-sensitive layer is composed of a charge transport layer and a charge generation layer chiefly made of an amorphous silicon or a germanium-containing amorphous silicon.

* * * * *